United States Patent [19]

Hayashida

[11] Patent Number: 4,543,459

[45] Date of Patent: Sep. 24, 1985

[54] SMALL-SIZED SWITCH

[75] Inventor: Kenji Hayashida, Muko, Japan

[73] Assignee: Hosiden Electronics Co., Ltd., Osaka, Japan

[21] Appl. No.: 558,251

[22] Filed: Dec. 5, 1983

[30] Foreign Application Priority Data

Dec. 20, 1982 [JP] Japan ..... 57-193428[U]

[51] Int. Cl.[4] ..... H01H 5/18

[52] U.S. Cl. ..... 200/67 D; 200/159 R

[58] Field of Search ..... 200/67 D, 153 J, 159 A, 200/159 R

[56] References Cited

U.S. PATENT DOCUMENTS

| | | | |
|---|---|---|---|
| 2,750,802 | 6/1956 | Pashby | 200/153 J |
| 3,037,099 | 5/1962 | Aandewiel | 200/67 D |
| 3,142,741 | 7/1964 | Bury | 200/67 D |
| 3,582,592 | 6/1971 | Schadow | 200/159 R |
| 4,045,632 | 8/1977 | Pierrot | 200/67 D |
| 4,130,747 | 12/1978 | Resh | 200/159 A |
| 4,398,075 | 8/1983 | Vogel | 200/67 A |

*Primary Examiner*—John W. Shepperd

*Attorney, Agent, or Firm*—Pollock, Vande Sande & Priddy

[57] ABSTRACT

A small-sized switch has a casing in which a movable contact member engages a first terminal and extends toward a second terminal having a fixed contact. The movable contact member includes an integral arcuate leaf spring extending from the end adjacent to the second contact toward the first contact, the movable contact member having a movable contact. An actuator is mounted on the casing for movement into and out of the casing. The switch also has a rocker pivotably disposed in the casing and held in engagement with the actuator. The leaf spring has a free end engaging the rocker. When the actuator is moved into or out of the casing, the rocker is turned thereby to cause the portion thereof engaging the leaf spring to traverse a line passing through the portion of the movable contact member engaging the first terminal and the movable contact, whereupon the movable contact on the movable contact member is snapped into or out of contact with the fixed contact on the second terminal.

12 Claims, 5 Drawing Figures

SMALL-SIZED SWITCH

BACKGROUND OF THE INVENTION

The present invention relates to a small-sized switch for use as a power supply switch on an electronic device, for example.

Prior small-sized switches have an actuator controllable to move a movable member pivotally up and down for bringing a movable contact into electric contact with a fixed contact. With such switches having the pivotally movable member, the actuator has to be moved in a relatively long stroke during operation, resulting in a cumbersome switching operation. Particularly, automatic control of the actuator requires a large-sized, complex arrangement for controlling the actuator. The conventional small-sized switches are also disadvantageous in that the movable member moves into and out of contact with the fixed contact at a relatively low speed, and hence a spark discharge is produced between the contacts when they are brought into and out of contact with each other. This causes the contacts to be deteriorated soon and have a short service life. To avoid such difficulties, it is necessary to reduce the current to be switched on and off by the switch. Where a relatively large current is to be handled, the contacts are required to be large in size. Accordingly, there have been available no small-sized switches capable of switching on and off relatively large currents.

SUMMARY OF THE INVENTION

It is accordingly an object of the present invention to provide a small-sized switch having an actuator which is movable in a short stroke during operation, controllable with a relatively small force, capable of making and breaking the circuit quickly, has reduced deterioration due to sparks produced when the switch is turned on and is off, has a long service life and small in size.

According to the present invention, first and second terminals are mounted on a casing of a rectangular parallelepiped and project into and out of the casing, and a movable contact member has one end engaging the first terminal in the casing and an opposite end extending toward the second terminal and supporting a movable contact, the second terminal supporting a fixed terminal. The movable contact member has an arcuate leaf spring integrally extending from the end supporting the movable contact toward the first terminal. An actuator is mounted on the casing for movement into and out of the casing in a direction in which the first and second terminals are spaced from each other. A rocker is pivotably mounted in the casing adjacent to the first terminal and has an engagement portion held in engagement with a free end of the leaf spring for normally urging the movable contact member to be displaced toward the second terminal. The rocker is held in engagement with the actuator in the casing. The rocker is angularly moved in response to movement of the actuator for causing the engagement portion of the rocker to traverse a line passing through the portion of the movable contact member engaging the first terminal and the movable contact, whereupon the movable contact on the movable contact member is snapped into or out of contact with the fixed contact on the second terminal.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
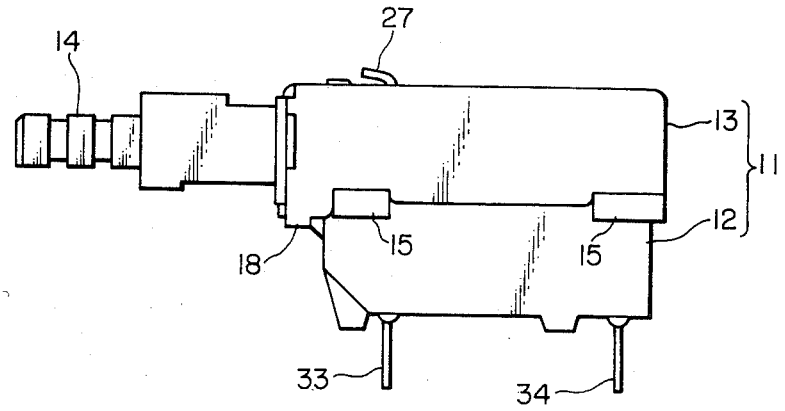
FIG. 1 is a front elevational view of a small-sized switch according to the present invention.
Figure 2:
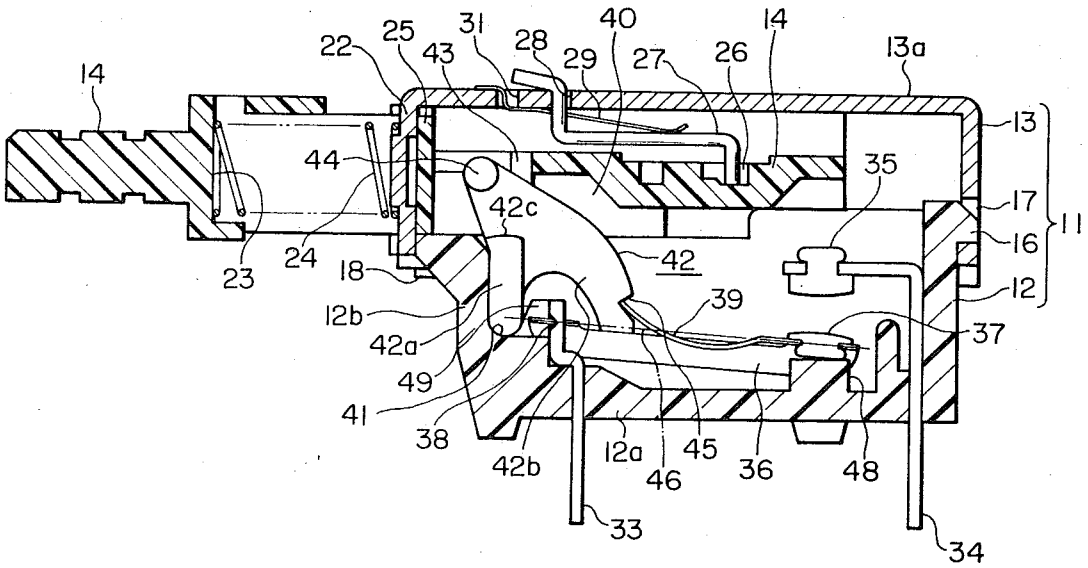
FIG. 2 is a longitudinal cross-sectional view of the switch shown in FIG. 1.
Figure 3:
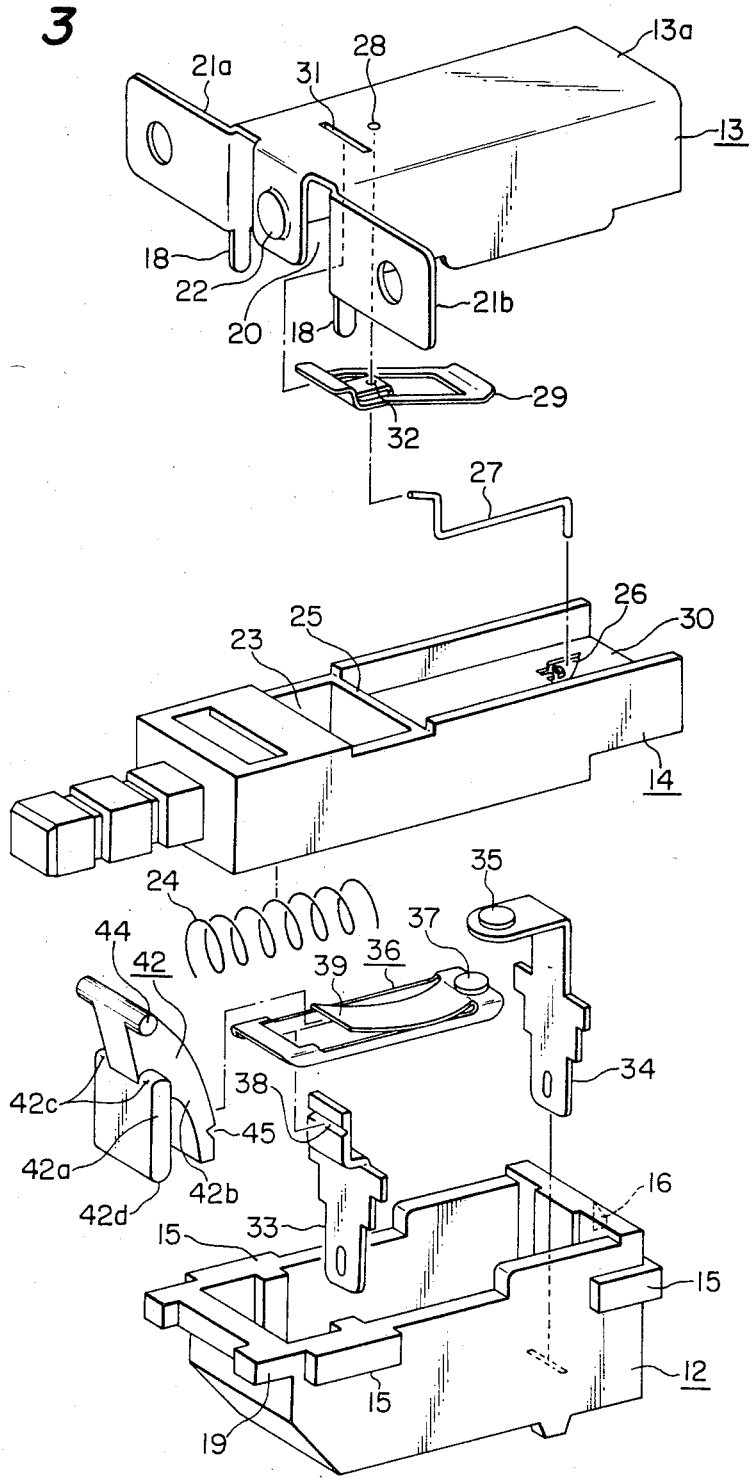
FIG. 3 is an exploded perspective view of the switch of FIG. 1.

As shown in FIGS. 1 through 3, a small-sized switch constructed in accordance with the present invention includes a casing 11 composed of a box-shaped body 12 made of an insulating material and having an upper open side and a cover 13 disposed in covering relation to the upper open side of the body 12. The body 12 is of substantially rectangular parallelepiped configuration. The switch also includes an actuator 14 movably mounted on an upper portion of one end of the body 12, that is, one end of the cover 13, the actuator 14 being movable into and out of the cover 13.

The cover 13 is prepared by bending a metal sheet, for example, into a hollow, substantially rectangular parallelepiped having an open side opening toward the body 12. As shown in FIG. 3, the body 12 has integral seats 15 positioned substantially at the corners thereof on an upper peripheral edge facing the cover 13. The cover 13 has its lower edge facing the body 12 and placed on the seats 15. As illustrated in FIG. 2, the body 12 has a small projection 16 integrally projecting away from the actuator 14 and inserted in a small hole 17 defined in the cover 13. As shown in FIG. 3, the cover 13 has on an end thereof supporting the actuator 14 a pair of fingers 18 integrally projecting from lateral sides toward the body 12 and bent around and over a ledge 19 projecting from one end of the body 12 below the actuator 14, as shown in FIG. 1. Accordingly, the cover 13 and the body 12 are mechanically coupled together. The body 12 and the actuator 14 are molded of synthetic resin.

As shown in FIG. 3, the cover 13 has a pair of integral attachment flanges 21*a*, 21*b* on the end supporting the actuator 14, which are bent outwardly away from each other from the sides of the cover 13. The cover 13 also has an opening 20 through which the actuator 14 extends, there being a tongue 22 integrally bent downwardly into the opening 20 from an upper plate 13*a* of the cover 13. The actuator 14 has a spring chamber 23 positioned out of the casing 11 as seen in FIG. 2, the tongue 22 being located in the spring chamber 23. As illustrated in FIG. 2, a coil spring 24 is disposed in the spring chamber 23 and has one end held against a wall of the actuator 14 partly defining the spring chamber 23 and the other end against the tongue 22. Therefore, the actuator 14 is normally urged by the spring 24 in a direction to move out of the casing 11. The actuator 14 is prevented from being dislodged out of the casing 11 by a wall 25 of the actuator 14 which will be held against the tongue 22, the wall 25 partly defining the spring chamber 23. The actuator 14 has opposite sides guided in substantially slidable contact with opposite inner sides of the cover 13.

The illustrated switch is of the pushbutton type in which the parts can be held in ON and OFF states independently. As shown in FIG. 3, the actuator 14 has a recess 30 opening toward the upper plate 13*a* of the cover 13 and a heart shaped cam groove 26 defined in the bottom of the recess 30. As illustrated in FIG. 2, a hook bar 27 extends in the direction in which the actuator 14 is movable and has one end inserted into the heart shaped cam groove 26 and the other end bent upwardly and projecting outwardly through a hole 28 defined in the upper plate 13*a* of the cover 13. The hook bar 27 is normally urged by one end of a presser spring 29 to cause the said one end of the hook bar to be normally disposed in the cam groove 26. The other end of the presser spring 29 projects out of and is retained by a slit 31 defined in the upper plate 13*a* of the cover 13. The hook bar 27 extends through a hole 32 defined in the presser spring 29. Since the hook bar 27 engages in the cam groove 26, the actuator 14 after having been inserted in the casing 11 is kept inserted therein. When the actuator 14 is further pushed in and thereafter released of the manual push, the actuator 14 projects under the spring resiliency from the casing 11 toward an initial position. This pushbutton mechanism is well known in the art, and various other constructions or mechanisms can be relied on in place of the illustrated arrangement.

As shown in FIG. 2, the body 12 has a bottom plate 12*a* supporting plate-like terminals 33, 34 spaced in the direction in which the actuator 14 is movable and projecting inwardly and outwardly across the bottom plate 12*a* of the body 12. The terminal 34 has an inner end positioned more closely than the inner end of the terminal 33 to the cover 13 and bent toward the terminal 33, there being a fixed contact 35 attached to the bent inner end of the terminal 34.

A movable contact member 36 is disposed in the body 12 and extends between the terminals 33, 34. The movable contact member 36 supports thereon a movable contact 37 positioned in confronting relation to the fixed contact 35 on the terminal 34. As shown in FIG. 3, the movable contact member 36 is substantially of a frame shape which is centrally open, as a whole, and has one end engaging in a transverse notch 38 of a V-shaped cross section in the terminal 33. More specifically, the transverse notch 38 is defined in a surface of the terminal 33 facing away from the terminal 34, and the terminal 33 extends through the frame-shaped movable contact member 36. An inner edge of the movable contact member 36 is held in the transverse notch 38 so as to be pivotably movable therearound. The movable contact member 36 includes an integral arcuate leaf spring 39 extending from the other end thereof supporting the contact 37 in and across the frame-shaped movable contact member 36 toward but terminating short of the first mentioned one end thereof engaging the terminal 33.

Figure 5:
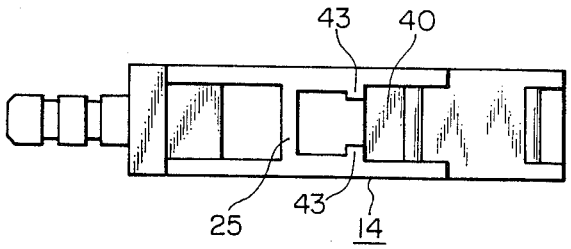
FIG. 5 is a bottom view of an actuator of the switch illustrated in FIG. 1.

In FIG. 2, a rocker 42 is disposed in the casing 11 closely adjacent to the terminal 33 for rocking movement in a fulcrum receiver 41 on the body 12 in response to movement of the actuator 14. The rocker 42 has one end engaging the free end of the leaf spring 39. More specifically, the actuator 14 has a recess 40 (FIG. 5) defined in its surface facing the body 12 within the casing 11 and extending in the direction of the movement of the actuator 14. The actuator 14 also has a pair of integral teeth 43 projecting toward each other from the opposite sides of the recess 40 adjacent to the wall 25. The rocker 42 has a pair of oppositely projecting engagement pins 44 disposed in an engagement space defined between the wall 25 and the teeth 43. The rocker 42 is of a bifurcated configuration comprising an arm 42*a* extending toward the fulcrum receiver 41 and an arm 42*b* extending toward the leaf spring 49. The arm 42*b* has in an end thereof an engagement groove 45 of a V-shaped cross section in which the free end of the leaf spring 49 engages. The arm 42*a* has a distal end constituting a fulcrum 42*d* pivotably inserted in the fulcrum receiver 41 defined on the body bottom 12*a* at the side of the terminal 33 adjacent to the actuator 14. In the illustrated embodiment, the bottom 12*a* of the body 12 has an integral side plate 12*b* adjacent to the actuator 14 and a pair of integral projections 49 (only one shown in FIGS. 2 and 4 with other one located more closely to the viewer). The fulcrum receiver 41 is composed of the bottom plate 12*a*, the side plate 12*b*, and the projections 49. The distal end of the arm 42*a* is rounded, and the fulcrum receiver 41 is shaped complementarily to the rounded end of the arm 42*a*. Thus, the rocker 42 is positioned by the fulcrum receiver 41 for smooth rocking movement. The arm 42*a* is wider than the arm 42*b*. When the actuator 14 projects to the greatest extent as shown in FIG. 2, shoulders 42*c* (FIG. 3) of the arm 42*a* adjacent to the pins 44 are held in substantial contact with lower edges of the opposite sides of the actuator 14, thereby keeping the rocker 42 held between the body 12 and the actuator 14. The rocker 42 may be molded of synthetic resin.

The engagement of the rocker 42 with the leaf spring 39 normally urges the movable contact member 36 toward the terminal 34 away from the terminal 33. As illustrated in FIG. 2, the line passing through the transverse notch 38 and the base portion of the leaf spring 39 submerged into the frame portion of the movable contact member 36 is referred to as a critical line 46. When the engagement groove 45 in which the leaf spring 39 engages is positioned on the side of the critical line 46 closer to the cover 13, as shown in FIG. 2, the movable contact 37 is urged into pressed contact with the bottom plate 12*a* of the body 12 and out of contact with the fixed contact 35.

Figure 4:
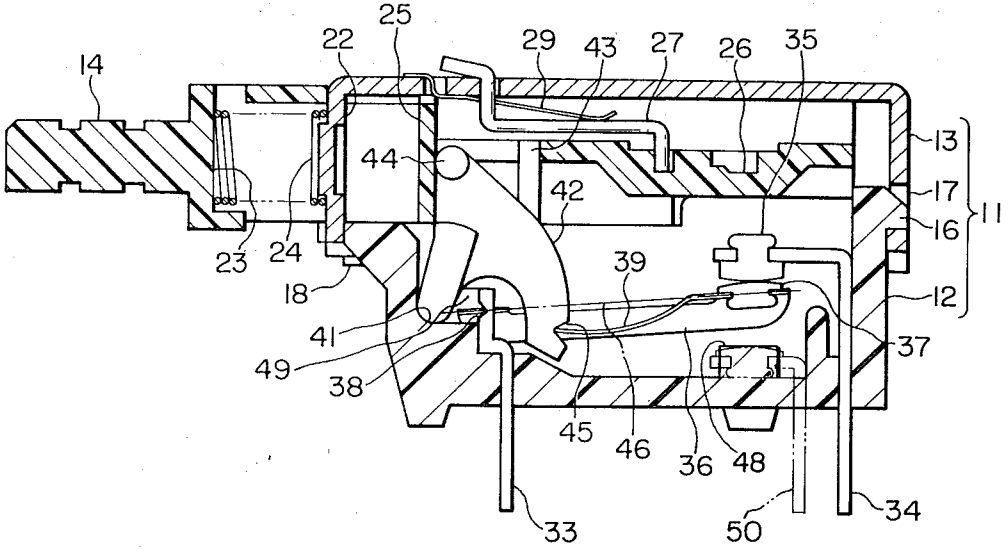
FIG. 4 is a cross-sectional view of the switch of FIG. 1, similar to FIG. 2, but showing a different contact position.

As the actuator 14 is pushed into the casing 11 against the biasing force of the spring 24 from the position of FIG. 2, the wall 25 of the actuator 14 causes the pins 44 to turn the rocker 42 clockwise as shown about the fulcrum 42*d*. When the groove 45 moves across the critical line 46, the movable contact 37 is caused by the action of the leaf spring 39 to be snapped into contact with the fixed contact 35 instantaneously as shown in FIG. 4, whereupon the terminals 33, 34 are electrically connected through the movable contact member 36.

Thereafter, the actuator 14 is slightly pushed again into the casing 11 and then released of the manual push. The actuator 14 is now shifted out of the casing 11 under the force of the spring 24 and returns to the position of FIG. 2. More specifically, the pins 44 engage the teeth 43 and the rocker 42 is turned counterclockwise as shown. When the groove 45 traverses the critical line 46, the movable contact 37 is momentarily snapped out of contact with the fixed contact 35, whereupon the terminals 33, 34 are electrically disconnected from each other. The bottom plate 12*a* of the body 12 may have an integral fixed seat 48 (FIGS. 2 and 4) disposed in confronting relation to the movable contact 37 for receiving the latter in order to shorten the stroke of movement of the actuator 14, that is, to connect and disconnect the terminals 35, 37 with a small stroke of the actuator 14. A third terminal 50 may be provided as shown by a broken line in FIG. 4 and the terminal 33 may be connected selectively to the terminal 34 and the third terminal 50.

With the small-sized switch constructed as above, the groove 45 in the rocker 42 in which the leaf spring 39 engages can be moved substantially perpendicularly across the critical line 46 from one side to the other thereof even by a slight rocking movement of the rocker 42 about the fulcrum 42*d* in response to the operation of the actuator 14. UPon the traversing of the groove 45 across the critical line 46 due to the pushed movement of the actuator 14, the movable contact 37 is instantaneously moved under the reversing motion of the leaf spring 39 into contact with the fixed contact 35 at high speed. Conversely, when the actuator 14 projects out of the casing 11, the movable contact 37 is quickly brought out of contact with the fixed contact 35. The rapid connection and disconnection of the contacts can prevent spark discharge from occurring between these terminals 35, 37, resulting in that the contacts will not be deteriorated soon and will have a long service life. Furthermore, it is possible to obtain a comparatively large pivotal movement of the movable contact 37 by a relatively small pivotal movement of the rocker 42, that is, by a relatively short stroke of the actuator 14.

The switch of the invention is relatively simple in construction, lightweight, and small in size. Since the engagement pins 44 are driven by the actuator 14 to turn the rocker 42 about the fulcrum 42*d*, the driving force applied to the actuator 14 can be reduced by increasing the radius of angular movement of the pins 44. Therefore, the switch can be operated with a reduced force. Furthermore, the quick snapping connection and disconnection allows an increased current capacity to be handled by the terminals 33, 34.

Where the rocker 42 is held by the fulcrum receiver 41 in the body 12 and between the wall 25 and the teeth 43 of the actuator 14, as in the foregoing embodiment, it is not necessary to provide a shaft fixed to the body and extending through the rocker, or a shaft integrally fixed to the rocker and extending through bearings on the body, a construction which is quite complex. The rocker 42 can easily be assembled in the casing 11 simply by positioning the arm 42*a* of the rocker 42 in the receiver 41 and placing the actuator 14 so that the engagement pins 44 will be disposed between the wall 25 and the teeth 43. Furthermore, with such an arrangement, the movable contact member 36 with the leaf spring 39 can also be assembled with ease by bringing the movable contact member 36 into engagement with the terminal 33 and also bringing the leaf spring 39 into resilient engagement with the rocker 42.

Although a certain preferred embodiment has been shown and described, it should be understood that many changes and modifications may be made therein without departing from the scope of the appended claims.

What is claimed is:

1. A switch comprising:

(a) a casing of rectangular parallelepiped configuration;

(b) first and second terminals projecting into and out of said casing and mounted on said casing in spaced, mutually insulated relation, said second terminal having a fixed contact;

(c) a movable contact member mounted in said casing and extending between said first and second terminals, said movable contact member having one end engaging said first terminal and a movable contact on an opposite end, said movable contact member including an integral arcuate leaf spring extending toward said first terminal;

(d) an actuator mounted on said casing for movement into and out of the casing in a direction in which said first and second terminals are spaced; and (e) a rocker rockably mounted in said casing adjacent to said first terminal and having a portion held in engagement with a free end of said leaf spring for urging said movable contact member toward said second terminal, said rocker being held in engagement with said actuator in said casing and rockably movable in response to movement of said actuator, the arrangement being such that said movable contact can be brought into and out of electric contact with said fixed contact when said portion of said rocker is moved across a line passing through said one end of said movable contact member and said movable contact;

(f) said rocker comprising a bifurcated configuration composed of first and second arms joined at an end of the rocker, said first terminal having an inner end disposed between said first and second arms, said first arm having an end substantially fitted and pivotably movable in a receiver in said casing, said second arm having an end engaging said leaf spring, said rocker having an engagement portion extending from said end of the rocker and engaging in an engagement space in said actuator positioned in said casing, said engagement portion being movable in said direction in which said actuator is movable.

2. A switch according to claim 1, wherein said engagement space is defined by a wall of said actuator extending substantially perpendicularly to said direction, and a pair of teeth of said actuator which are located inwardly of said wall in said direction and arranged substantially perpendicularly to said direction, said engagement portion of said rocker comprising a pair of opposite engagement pins extending integrally from said rocker substantially perpendicularly to said direction and positioned between said wall and said teeth, said second arm being positioned between said pair of teeth.

3. A switch according to claim 2, wherein said first arm is wider than said second arm, said first arm having shoulders located adjacent to said engagement pins and projecting along said engagement pins, said shoulders being engageable with side edges of said actuator which extend along said direction.

4. A switch according to claim 1, including a coil spring acting between said casing and said actuator for normally urging the actuator to move out of said casing.

5. A switch according to claim 4, including a push-button mechanism disposed between said casing and said actuator for retaining said actuator in said casing after said actuator has been pushed into said casing, and for allowing said actuator to project out of said casing under the force of said coil spring when said actuator is released of a manual push after it has been slightly pushed into the casing.

6. A switch according to claim 5, wherein said casing comprises a body having an open side and housing therein said first and second terminals and said movable contact member, and a cover disposed in covering relation to said open side of said body, said cover having in an end thereof an opening through which said actuator is inserted into said casing.

7. A switch according to claim 6 wherein said actuator has a spring chamber that is normally located outside of said casing, a tongue formed integrally with one end of said cover and projecting through said opening into said spring chamber, said coil spring being inserted between said tongue and a wall of said actuator which defines said spring chamber for normally urging said actuator to move out of said casing.

8. A switch according to claim 7, wherein said body, said actuator, and said rocker are molded of synthetic resin, said cover being made of a bent metal sheet.

9. A switch according to claim 1, wherein said first terminal is in the form of a plate, said movable contact member comprising a centrally open frame, said movable contact being attached to said frame at an end thereof adjacent to said second terminal, said leaf spring integrally extending from the end supporting said movable contact in and across said frame toward said first terminal, said frame having an edge disposed adjacent to said first terminal and engaging the latter.

10. A switch according to claim 1, wherein said casing has a bottom plate on which said first and second terminals are mounted, said second terminal having an inner end bent and extending toward said first terminal and supporting said fixed contact in confronting relation to said movable contact.

11. A switch according to claim 1, wherein said casing has a seat disposed remotely from said fixed contact in confronting relation to said movable contact for receiving said movable contact.

12. A switch according to claim 1 including a third terminal fixedly mounted on said casing, said third terminal having one end thereof located inside of said casing and having the other end thereof located outside said casing, said one end of said third terminal having a second fixed contact thereon disposed in opposing relation to said first mentioned fixed contact, said movable contact being movable between said first and second fixed contacts.

* * * * *